United States Patent [19]

Sauer

[11] Patent Number: 4,583,340

[45] Date of Patent: Apr. 22, 1986

[54] FIXTURE SUPPORT CLIP FOR SUSPENSION CEILING GRID SYSTEMS

[75] Inventor: Gale E. Sauer, North Olmsted, Ohio

[73] Assignee: Donn Incorporated, Westlake, Ohio

[21] Appl. No.: 606,531

[22] Filed: May 3, 1984

[51] Int. Cl.[4] ..... E04B 5/52; E04C 2/42

[52] U.S. Cl. ..... 52/484; 52/665

[58] Field of Search ..... 52/484, 665; 248/214; 403/346, 347

[56] References Cited

U.S. PATENT DOCUMENTS

| | | | |
|---|---|---|---|
| 2,994,113 | 8/1961 | Dail | 52/484 |
| 3,329,387 | 7/1967 | Fischer | 248/342 |
| 3,589,660 | 7/1971 | Dunckel | 248/343 |
| 3,599,921 | 8/1971 | Cumber | 52/484 X |
| 4,479,341 | 10/1984 | Schuplin | 52/665 |

FOREIGN PATENT DOCUMENTS

| | | | |
|---|---|---|---|
| 281386 | 2/1966 | Australia | 52/484 |

*Primary Examiner*—John M. Jillions
*Assistant Examiner*—Lynn M. Sohacki
*Attorney, Agent, or Firm*—Pearne, Gordon, Sessions, McCoy, Granger, Tilberry

[57] ABSTRACT

A fixture support clip is disclosed for use with a suspension ceiling grid system. Such grid system provides transversely interconnecting runners having a central web and opposed ceiling support flanges for supporting ceiling members such as ceiling tiles or lighting fixtures. The clip provides shelf means for supporting a corner portion of a ceiling member. The shelf means is supported at the lower end of two posts. The posts carry hook means at their upper end which are removably attached to the upper extremities of the transversely interconnecting runners near the corners thereof. The lengths of the posts are selected so that the shelf means lies substantially parallel with and vertically adjacent to the support flanges and provides a greater support area to a corner portion of a ceiling member than provided by the flanges.

19 Claims, 5 Drawing Figures

FIXTURE SUPPORT CLIP FOR SUSPENSION CEILING GRID SYSTEMS

BACKGROUND OF THE INVENTION

The present invention relates generally to suspension ceiling grid systems. More specifically, the present invention relates to a new and improved fixture support clip for a suspension ceiling grid system, wherein the clip provides support means to ensure that fixtures are properly supported and also provides a centering function.

PRIOR ART

A typical grid system used for suspending a ceiling includes inverted T-shaped members which are formed with a central web, a bulb along the upper extremity of the web and oppositely extending support flanges at the lower edges of the web. The bottom surface of adjacent flanges forms the grid face.

A first set of main runners span longitudinally across the ceiling area and typically are laterally spaced apart at standard distances. A second set of cross-runners span longitudinally across the ceiling area tranversely the main runners and also are laterally spaced apart at standard distances. At each location where the main and cross-runners intersect each other, the runners are interconnected to form a support grid. The interconnected runners thereby form grid openings bounded by the support flanges of the runners.

The grids so formed may be used for supporting, inter alia, ceiling members such as ceiling panels and light fixtures. The panels and fixtures may be shaped in the same configuration as the grid openings; therefore, the use of standardized panel and fixture sizes is desirable from an economic viewpoint as construction is greatly simplified.

The center-to-center distance between runner webs on opposite sides of each grid opening determines the module size of the panel or fixture to be supported therein. A common module size is 2'×4' so that the center-to-center spacing of the grid members extending along the long sides of the grid openings is 2 feet and the center-to-center spacing of the grid members extending along the short sides of the grid openings is 4 feet. A typical grid face is 15/16 inch to one inch in width so that each peripheral edge of a lay-in panel or fixture is supported by a flange about 15/32 inch wide.

The standard light fixtures used with such a grid arrangement are undersized in both directions ¼ inch ±1/32 inch. The fixtures are purposely undersized to allow clearance between the peripheral sides of a fixture and the grid members as the fixtures are positioned in or removed from the grid openings. This clearance ensures that the fixtures can be dropped down past the grid bulbs and the drop wires without interference therefrom and without binding on the central webs.

The light fixtures are typically made of a sheet metal frame supporting fluorescent light, ballast etc. above the ceiling plane and usually provide a lens. Consequently, the light fixtures can be quite heavy. Therefore, it is important to provide a support structure which assures they do not fall through the grid openings.

When light fixtures are undersized ¼±1/32 inch, the minimum dimensions of a fixture for use with a standard 2'×4' grid system is 1 foot, 11-23/32 inches by 3 feet, 11-23/32 inches. Since the standard grids have a flange width of at least 15/32 inch, the spacing between the web of a grid member from one side of a grid opening to the closest edge of the fixture supporting flange on the opposite side of the same opening is 1 foot, 11-17/32 inches on the long side of the grid opening and 3 feet, 11-17/32 inches along the short side. For purposes of this discussion the webs are assumed to have zero thickness as they are generally formed of thin metal.

Thus, in a standard system, the minimum fixture dimension exceeds its corresponding grid opening dimension by at least 3/16 inch, and a non-centered fixture (as with a fixture positioned so that one or two of its peripheral edges are against the adjacent web) still extends over the opposed support flange by more than ⅛ inch which is generally considered to be the minimum overlap required between a light fixture and a supporting flange to assure proper support. When a fixture is properly centered, the supporting flange extends under each fixture edge by more than ¼ inch.

Because of the approximate ¼ inch clearance requirement, conventional grid systems require flanges which form a grid face having a support area at least about 15/16 inch in width. In some instances, however, it is desirable, from an aesthetic viewpoint and to reduce the amount of material used, to provide narrower faced grids.

Narrow-faced grids have been produced with face widths of about 9/16 inch. Such a system is shown in the co-pending application Ser. No. 535,382 filed Sept. 23, 1983. Such systems have an associated problem that an off-center light fixture may not be properly supported and could fall through the grid openings. In accordance with the preceding analysis of a conventional grid system, if a standard minimum dimension fixture of 1 foot, 11-23/32 inches by 3 feet, 11-23/32 inches were completely off-center in a narrow-faced grid opening (flanges of 9/32 inch width), the fixture edge opposite the edge adjacent the web would be adjacent to and not extend over the opposite supporting flange. Even if perfectly centered the flange would extend under each edge of the fixture only 9/64 inch or barely more than the ⅛ inch minimum requirement.

One prior art assembly for supporting fixtures is shown in U.S. Pat. No. 3,329,387 (Fischer). A support clip is shown which uses a main clip and secondary clip spot-welded together. While the clip shown can be used with an inverted T-grid system, there is no suggestion as to a structure which supports a light fixture flushly with the grid. The clip arrangement shown in FIG. 13 of the reference shows only lateral edge support of a fixture and does not suggest a means by which a fixture could be supported with a narrow-faced grid without a substantial interference with the aesthetic view while still maintaining the lay-in feature of fixtures used in ceiling structures conveniently requiring minimum labor to install.

In another prior art reference, U.S. Pat. No. 3,589,660 (Dunckel), a clip is shown which attaches to the flanges and supports a light fixture suspended from the proximity of the ceiling. Again there is no suggestion as to a means by which a fixture can be supported flush with the suspended ceiling nor is there any suggestion as to supporting a fixture on a narrow-faced grid while maintaining the drop-in assembly convenience.

It is apparent, therefore, that the need exists for a fixture support mechanism which provides proper support to a light fixture without substantially interfering with the simplified lay-in assembly or aesthetic view of a finished suspended ceiling and which is particularly adaptable to a narrow-faced grid.

SUMMARY OF THE INVENTION

The present invention provides a novel and improved support for lighting fixtures and the like which is easily installed on a suspension ceiling grid system and which provides proper support for a fixture even in a narrow faced grid system. Further, such support clip operates to center the fixture in the grid opening so that the fixture edges are not exposed.

The illustrated embodiment of a fixture support clip incorporating the concepts of the present invention includes shelf means for supporting a corner portion of a light fixture or the like. The shelf means are carried by and between first and second extension posts. The first post is removably attached at one end to the upper extremity of the first runner near the corner.

The second post is removably attached at one end to the upper extremity of the second runner near the corner so that the shelf means is substantially in the plane of the flange support structure. The shelf means are sized to extend beyond the edges of the flanges and therefore extend under the fixture a greater amount than the flanges. Therefore the shelf means provides improved and more reliable fixture support.

Further the illustrated support clip is structured so that the extension posts engage the lateral edges of the fixture and automatically center the fixture in the opening. This insures that the edges of the fixture overlap the grid flanges and are not exposed.

Still further the second post is laterally spaced further from the corner than the first post so that more than one clip can be attached to a common runner at two adjacent corners. In fact, the clip is structured so that four clips can be installed at each grid intersection.

Thus, the clip shown herein substantially and uniquely adds to the utility of such grids by minimizing one of the problems associated therewith, namely the reduced support area for fixtures resulting from the narrower flange widths.

These and other aspects of this invention are illustrated in the accompanying drawings, and are more fully described in the following specification.

DETAILED DESCRIPTION OF THE DRAWINGS

Figure 1:
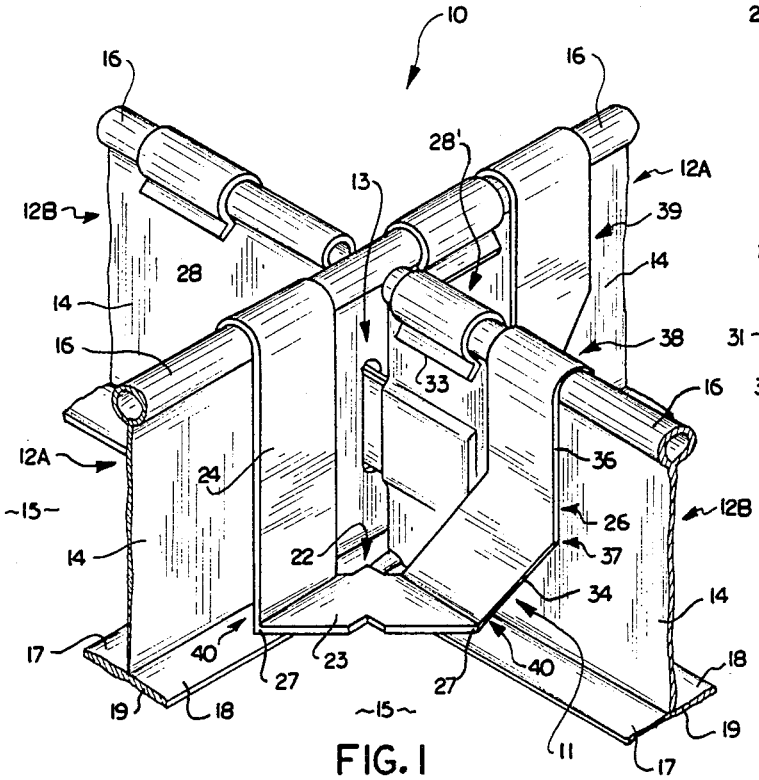
FIG. 1 is a perspective view of a grid tee intersection with three support clips in accordance with this invention mounted thereon.

A portion of a grid system 10 used with a fixture support clip 11 according to the present invention is shown in perspective in FIG. 1. A plurality of grid tees or runners 12 are suspended from a main support structure as by drop wires (not shown). Runners 12 traverse an area over which a suspended ceiling is to be located. To form the grid, main runners 12A are interconnected with cross runners 12B to form grid openings 15 to receive panels and fixtures. A typical grid is formed with rectangular grid openings 15. The transversely intersecting grid tees are interconnected as by a locking mechanism 13, known to one skilled in the art. Such a grid system is shown in the co-pending application Ser. No. 535,382, (assigned to the assignee of this invention) the disclosure of which is fully incorporated herein by reference.

The illustrated grid tees 12 include a central web 14 providing a bulb 16 along the upper extremity thereof, and opposed laterally extending flanges 17 and 18 along the lower extremity of web 14. The bottom surface 19 of flanges 17 and 18 form a smooth grid face which is in view from below the ceiling.

To complete a typical grid-type suspended ceiling, ceiling members such as ceiling panels or fixtures such as light fixtures 20 (FIG. 2, partially shown in phantom) are lowered into grid openings 15. The panels or fixtures 20 are standard nominal sizes, such as for example 2'×4', and are sized to fit into the grid openings with clearance. The actual sizes selected are a matter of design choice, 2'×4' simply chosen for exemplary purposes. Flanges 17 and 18 provide the support structure for the panels and fixtures 20 along their perimeter as shown in FIG. 2.

Each grid opening 15 is formed by two pairs of parallel runners 12. In a conventional grid system providing 2'×4' grid openings, the center line distance between the cross-runners 12B may be 2 feet and the distance between the main runners 12A may be 4 feet. A typical grid face 19 is 15/16–1 inch so that each flange 17 and 18 is at least 15/32 inch wide. To avoid interference with webs 14 and bulbs 16 during lay-in installation, light fixture 20 is undersized ¼ inch ±1/32 inch. The nominal ¼ inch provides clearance between the peripheral edges of the fixture 20 and the webs.

Figure 2:
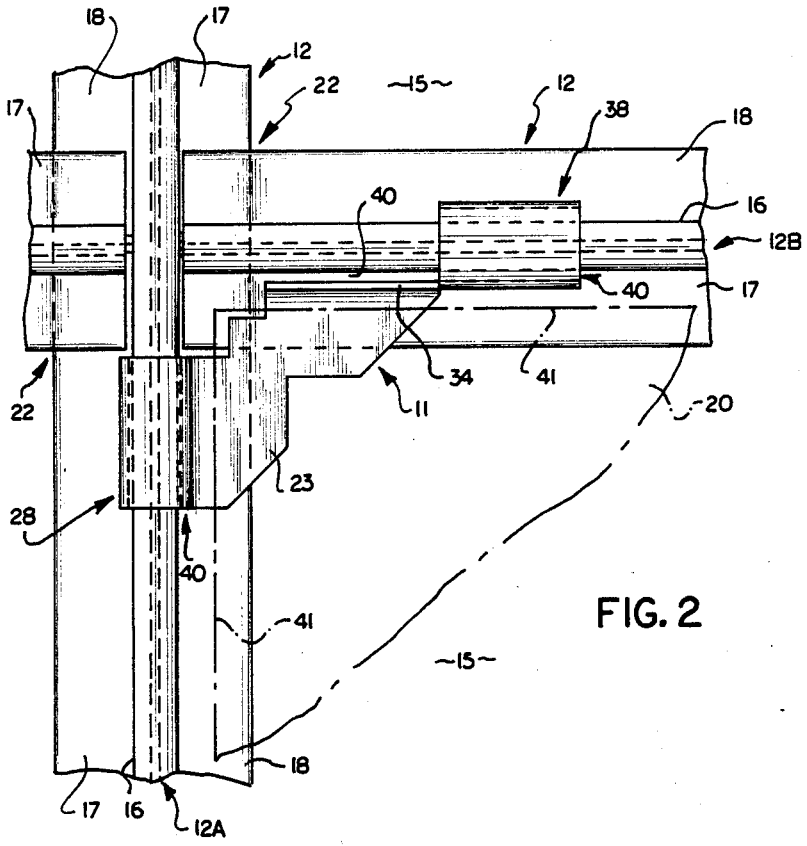
FIG. 2 is a top plan view of the portion of the narrow-faced grid system shown in FIG. 1, with only one clip installed for clarity and with a corner portion of a fixture shown in phantom.
Figure 3:
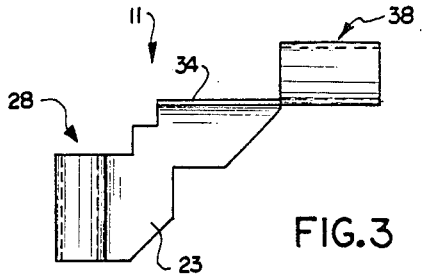
FIG. 3 is a top plan view of a clip according to the concepts of the present invention.

Because of the allowed clearance factor, the full width of flanges 17 and 18 does not support even a properly centered panel or fixture as shown in FIG. 2. A fixture is properly centered when the lateral distances between its four sides and their respective adjacent central webs 14 are all substantially equal.

As discussed hereinbefore, the minimum dimension for a standard 2'×4' light fixture 20 undersized ¼ inch ±1/32 inch would be 1 foot, 11-23/32 inch by 3 feet, 11-23/32 inch. With each flange 17 and 18 of minimum 15/32 inch width, a fixture completely off-center, as by having one edge abutting its adjacent web, will still be supported by more than ⅛ inch width along the opposite parallel edge.

When the flange width, however, is reduced, for aesthetic as well as cost reasons, to a width which is substantially the same as the ¼ inch clearance distance, it is possible that an off-center fixture will have a completely unsupported edge. That is, if flanges 17 and 18 are only 9/32 inch wide, since the standard clearance is possibly 9/32 inch wide, an off-center fixture could have at least one edge extending only to the edge of the adjacent flange and not supported thereby. Since fixtures can be quite heavy this condition can be quite hazardous.

While the same general problem exists for the ceiling panels, the co-pending application Ser. No. 535,382 illustrates a structure for centering such panels in a narrow-faced grid so as to ensure proper support.

In order to properly support fixtures and the like, a support clip 11 is provided. Referring to FIG. 1, wherever two transversely oriented runners are interconnected, a plurality of substantially right angled corners are formed as between a main runner 12A and a cross-runner 12B. Clearly, for every pair of interconnected runners 12, up to four adjacent corners may be formed. Since all corners exhibit the same basic structure, details as to only one corner will be provided herein.

In the preferred embodiment, clip 11 is constructed so that up to four clips per interconnection may be used, one at each of the four corners formed by two interconnected runners, as will be more fully described hereinafter. The preferred design of the clip enables light fixtures to be fully supported at adjacent grid openings 15.

Each corner formed by runners 12A and 12B provides a flange support structure 22 formed by the upper surfaces of flanges 17 and 18. Structure 22 provides support to a corner portion of a lay-in fixture or panel 20 disposed within the corner (shown in phantom in FIG. 2). As stated hereinbefore, when narrow flanges 17 and 18 are used, an off-center fixture may not be properly supported along one or more of its perimeter edges, including the corners.

Figure 4:
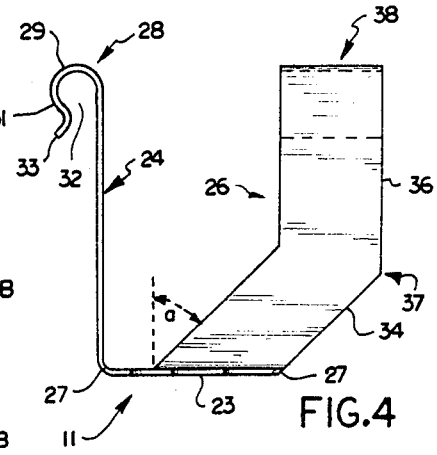
FIG. 4 is a side elevation of the clip shown in FIG. 3.

Clip 11 includes a shelf 23 which may be generally flat to accept and support corner portion 20 of a fixture or panel. Shelf 23 is disposed between two extension posts 24 and 26. Shelf 23 and posts 24, 26 are made from a unitary piece of material as by bending posts 24, 26 upwardly at 27. Post 24 extends upwardly and substantially vertically from shelf 23 to a curved portion 28, as best shown in FIG. 4. Portion 28 forms a snap-on type clip as by curving outwardly at 29 and then curving back inwardly at 31 to form a channel 32 which releasably accepts bulb 16 near the corner. An outwardly flared strip 33 facilitates the insertion of bulb 16 into channel 32 camming the channel open as the clip is installed.

Since bulb 16 extends outwardly on either side of central web 14, post 24 is laterally spaced from web 14 by a distance approximately the outer radius of bulb 16 as best shown in FIG. 1. The same is true for post 26. Of course, the actual shape of curved portion 28 can be modified to accept a bulb of different cross-sectional shape or not to include the snap-on function but simply a drop-on function.

Figure 5:
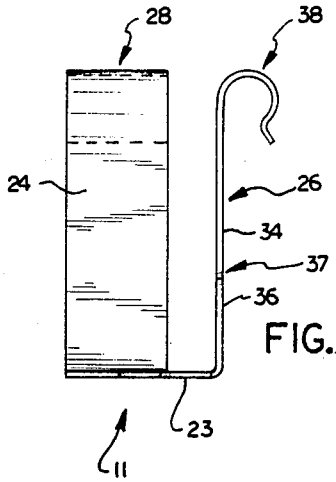
FIG. 5 is a side elevation of the clip shown in FIG. 4 and rotated 90 degrees counter-clockwise about the vertical axis.

Extension post 26 includes a lower segment 34 and an upper segment 36. As best shown in FIGS. 4 and 5, the lower segment 34 extends upwardly from shelf 23 but laterally away from post 24 as at an angle a. Angle a is shown to be about a 45° angle, but other angles could be selected. Segment 34 joins segment 36 as at 37. Segment 36 extends upwardly and substantially vertically from segment 34 to a second curved portion 38. Portion 38 provides a snap-on clip arrangement similar to portion 28 to accept bulb 16 near the corner as described hereinbefore.

The angle a and the vertical lengths of portions 34 and 36 are selected so that more than one clip may be partly affixed to a single runner 12, as will be more fully discussed hereinafter.

FIG. 1 illustrates how the clip 11 design permits the use of a plurality of such clips attached to common runners 12. Angle a and the vertical height of segment 34 are selected so that portion 38 is laterally spaced further from the corner formed between runners 12A and 12B than is portion 28. Thus, when a second clip 39 is installed in an adjacent corner which has runner 12B as a common support, portion 38 of clip 11 is spaced from the intersection of the runner beyond the portion 28' of the clip 39. With this structure up to four clips can be simultaneously installed, one at each of the four corners formed by two interconnected runners 12A and 12B. The use of three clips is shown in FIG. 1.

Extension posts 24 and 26 are sized so that when mounted to their respective grid tees 12A and 12B, the shelf 23 lies parallel with flanges 17 and 18 and is substantially coplanar with the flange support structure 22 so that a corner portion of a fixture 20 is supported along the plane of the flanges 17 and 18. In effect, as best shown in FIG. 2, shelf 23 increases the corner support area to a light fixture 20 by extending further under the corner portion of the fixture than do flanges 17 and 18. The size of shelf 23 may be selected so as to provide the same support area to a fixture corner as would be provided by flanges of conventional 15/32 inch width. Shelf 23 extends laterally further from runners 12A and 12B than do flanges 17 and 18, as best shown in FIG. 2. Therefore, even off-center fixtures can be properly supported for use with a narrow faced grid with minimal interference with the aesthetic improvements of narrow-faced grids and while still maintaining the simple lay-in assembly feature of the suspension ceiling, no matter how narrow grid faces 19 are made.

It is important to note also that in addition to providing proper support to a light fixture or like structure, clip 11 also provides a centering function, as best shown in FIG. 2. As stated previously, extension posts 24 and 26 are laterally spaced from their adjacent web by at least the radius of the bulb to which the extensions are attached as at 40. This lateral spacing has the effect of reducing the allowed $\frac{1}{4}'' \pm 1/32''$ undersize clearance when the fixtures are placed into grid openings 15, thereby reducing the amount of space by which a fixture could be off-center, because extension posts 24 and 26 will prevent a fixture edge 41 from being shifted over and abutting the webs of the adjacent runners 12A and 12B respectively. This centering function thus helps to prevent "peekers" which are occurrences of being able to see the edge of a fixture (i.e. a gap between a fixture edge and a flange) because of a shift off-center of the fixture. This is particularly important with the narrow-faced grids.

It will be appreciated by one skilled in the art that the support clip shown herein could be used with conventional sized grids as well as with narrow-faced grids should added support be deemed necessary. Also, the clip could be used to add support to other types of fixtures and even to ceiling tiles. The structure and application of the present invention have been disclosed herein for exemplary purposes only and such specific aspects should not be construed as limiting in any sense.

Although the preferred embodiment of this invention has been shown and described, it should be understood that various modifications and rearrangements of the parts may be resorted to without departing from the scope of the invention as disclosed and claimed herein.

What is claimed is:

1. A suspension ceiling grid system comprising a plurality of interconnected runners providing web means and opposed flanges extending from the one edge of said web means, connectors interconnecting said runners at intersections, said runners cooperating to define at least one grid opening bounded by said flanges, separate support clips secured to said runners near said intersections bounding said opening providing support shelves substantially coplanar with said flanges and projecting into said opening beyond said flanges wherein said support shelves are carried by and between first and second posts, said first post removably attached to a first runner and said second post removably attached to a second runner and a fixture positioned in said opening providing a peripheral surface overlying and supported by both said flanges and said support shelves, said support shelves extending inwardly along said peripheral surface beyond said flanges to increase the lateral extent of supporting overlay of said fixture.

2. A grid system according to claim 1 wherein said clips are removably attached to said runners.

3. A grid system according to claim 2 wherein said second post is spaced from said intersection further than said first post is spaced from said intersection so that another post of a second similar clip may be attached to said second runner between said intersection and said second post.

4. A grid system according to claim 3 wherein said second post comprises lower and upper segments, said lower segment extending upwardly from said shelf and laterally away from said intersection to said upper segment, said upper segment extending upwardly from said lower segment so that said upper segment is laterally spaced further from said intersection and said first post.

5. In a suspension ceiling grid having a plurality of interconnected runners forming the grid and providing at least one grid opening, the runners providing web means and opposed flanges extending laterally into the grid opening from the lower extremity of the web means, a plurality of corners formed at the interconnection of a first runner and a second runner, the flanged surfaces near a corner supporting a corner portion of a ceiling member, the improvement comprising a separate support clip at each corner, said clips having shelf means for providing support to a corner portion of the ceiling member, said shelf means being substantially parallel with and vertically adjacent to the flanged surfaces and providing a larger support area to the corner portion of the ceiling member than that provided by the flanged surfaces wherein said shelf means is carried by and between first and second posts, said first post removably attached to the first runner near the corner and said second post removably attached to said second runner near the corner.

6. A ceiling grid according to claim 5 wherein said first and second posts extend downwardly and substantially vertically from the upper extremities of the runners and are formed with said shelf means from a single piece of material.

7. A ceiling grid according to claim 6 wherein said first and second posts are spaced from the webs respectively adjacent thereto so that a fixture, undersize with respect to the grid opening, having corner portions thereof supported by said clip, is restricted by said post from shifting substantially adjacent the first or second web means.

8. A ceiling grid according to claim 5 wherein said second post is spaced from the corner further than said first post is spaced from the corner so that another post of a second clip may be attached to the second runner between the corner and said second post.

9. A ceiling grid according to claim 8 wherein said second post comprises lower and upper segments, said lower segment extending upwardly from said shelf means and laterally away from the corner to said upper segment, said upper segment extending upwardly from said lower segment so that said upper segment is laterally spaced further from the corner than said first post.

10. A ceiling grid according to claim 5 wherein said shelf means is a substantially flat and cornered piece of material which extends laterally further into the grid opening than the flanged surfaces.

11. A ceiling grid according to claim 10 wherein said shelf means is substantially the same thickness as the flanges.

12. A support clip adapted to be used in a suspension ceiling grid at corners formed at the substantially transverse interconnection of two grid tees, the corners providing a flanged support area extending from the lower extremity of the grid tees, said support clip comprising shelf means substantially parallel with and vertically adjacent to the flanged support area extending laterally further from the grid tees than the flanged support area when the support clip is used with the suspension ceiling grid, said shelf means providing additional corner support for fixtures supported by said ceiling grid wherein said shelf means is attached to first and second posts, said first post having hook means for releasably attaching said first post to the first grid tee and said second post having a second hook means for releasably attaching said second post to the second grid tee.

13. A support clip as set forth in claim 12 wherein said second hook means is laterally spaced further from the corner than said first hook means when the support clip is attached to the grid tees so that adjacent corners which have a common grid tee can have a clip disposed therein.

14. A support clip as set forth in claim 13 wherein said second post includes lower and upper segments, said lower segment extending upwardly from said shelf means and laterally away from said first post to said upper segment and said upper segment extending upwardly from said lower segment to said second hook means.

15. A support clip as set forth in claim 14 wherein said shelf means is a substantially flat member having a first side attached to said first post and a second side to said second post.

16. A support clip as set forth in claim 12 wherein said shelf means and said first and second posts are formed of a single and continuous piece of material.

17. A support clip as set forth in claim 12 wherein said first and second posts extend substantially vertically upward from said shelf means to said first and second hook means respectively.

18. A support clip as set forth in claim 17 wherein said first and second posts are spaced from the grid tees respectively adjacent thereto when the support clip is attached to the grid tees near the corner so that a corner portion of a fixture supported by the clip is restricted by said posts from shifting substantially adjacent the webs of the interconnecting grid tees forming the corner.

19. A suspension ceiling grid system as set forth in claim 1, wherein said support clips provide vertically extending portions spaced from the adjacent of said web means, said fixture being undersized with respect to said opening, said vertical portions operating to center said fixture within said opening so that said flanges provide substantially uniform support for said fixture around said opening, and said shelves provide additional and substantially uniform support for said fixture at said corners.

* * * * *